US007129654B2

(12) United States Patent
Tsai et al.

(10) Patent No.: US 7,129,654 B2
(45) Date of Patent: Oct. 31, 2006

(54) FLASHING LIGHT CONTROL APPARATUS AND METHOD THEREOF

(75) Inventors: Jung-Yuan Tsai, Taoyuan (TW); Kuo-Feng Chen, Taoyuan (TW); Chung-An Chien, Taoyuan (TW); Wei-Shao Chen, Taoyuan (TW)

(73) Assignee: High Tech Computer Corp., Taoyuan Hsien (TW)

( * ) Notice: Subject to any disclaimer, the term of this patent is extended or adjusted under 35 U.S.C. 154(b) by 0 days.

(21) Appl. No.: 10/983,608

(22) Filed: Nov. 9, 2004

(65) Prior Publication Data

US 2006/0033456 A1 Feb. 16, 2006

(30) Foreign Application Priority Data

Aug. 10, 2004 (TW) ..... 93123966 A

(51) Int. Cl.
*H05B 39/00* (2006.01)
*G08B 5/22* (2006.01)

(52) U.S. Cl. ..... 315/312; 340/815.45; 340/691.1; 315/315; 315/317; 315/318

(58) Field of Classification Search ..... 315/200, 315/185 R, 312; 396/157, 176; 340/815.45, 340/691.1; 345/82
See application file for complete search history.

(56) References Cited

U.S. PATENT DOCUMENTS

| | | | | |
|---|---|---|---|---|
| 5,581,315 | A * | 12/1996 | Ishiguro | 396/176 |
| 5,807,287 | A * | 9/1998 | Cheng | 601/60 |
| 5,903,103 | A | 5/1999 | Garner | 315/76 |
| 5,969,479 | A | 10/1999 | Wong | 315/224 |
| 7,046,160 | B1 * | 5/2006 | Pederson et al. | 340/815.45 |
| 2003/0174496 | A1 | 9/2003 | Wong | 362/118 |
| 2005/0088568 | A1 * | 4/2005 | Uenaka | 348/370 |
| 2005/0089322 | A1 * | 4/2005 | Uenaka | 396/157 |

OTHER PUBLICATIONS

"I²C Devices for LED Display Control"; Integrated Circuits—Application Note; Philips Semiconductors; Jean-Marc Irazabal et al.; Jun. 22, 2002; p. 1-27.

* cited by examiner

*Primary Examiner*—Tho Phan
*Assistant Examiner*—Chuc Tran
(74) *Attorney, Agent, or Firm*—Rabin & Berdo, P.C.

(57) ABSTRACT

The present invention describes a flashing light apparatus and method for operating the same. A pulse signal generated by a pulse signal generator and the states of the general purpose Input/Output pins of a CPU are used to control the lights to flash.

4 Claims, 5 Drawing Sheets

| No | LED R | LED G | LED B | LPG | GPIO 1 | GPIO 2 | GPIO 3 |
|---|---|---|---|---|---|---|---|
| 1 | Flash | OFF | OFF | ON | Input | Output (L) | Output (L) |
| 2 | OFF | Flash | OFF | ON | Output (L) | Input | Output (L) |
| 3 | OFF | OFF | Flash | ON | Output (L) | Output (L) | Input |
| 4 | Flash | Flash | OFF | ON | Input | Input | Output (L) |
| 5 | OFF | Flash | Flash | ON | Output (L) | Input | Input |
| 6 | Flash | OFF | Flash | ON | Input | Output (L) | Input |
| 7 | Flash | Flash | Flash | ON | Input | Input | Input |
| 8 | OFF | OFF | OFF | OFF | Output (L) | Output (L) | Output (L) |

FIG. 5

| No | LED R | LED G | LED B | LPG | GPIO 1 | GPIO 2 | GPIO 3 |
|---|---|---|---|---|---|---|---|
| 9 | ON | OFF | OFF | OFF | Output (H) | Output (L) | Output (L) |
| 10 | OFF | ON | OFF | OFF | Output (L) | Output (H) | Output (L) |
| 11 | OFF | OFF | ON | OFF | Output (L) | Output (L) | Output (H) |
| 12 | ON | ON | OFF | OFF | Output (H) | Output (H) | Output (L) |
| 13 | OFF | ON | ON | OFF | Output (L) | Output (H) | Output (H) |
| 14 | ON | OFF | ON | OFF | Output (H) | Output (L) | Output (H) |
| 15 | ON | ON | ON | OFF | Output (H) | Output (H) | Output (H) |
| 16 | OFF | OFF | OFF | OFF | Output (L) | Output (L) | Output (L) |

FIG. 6

FLASHING LIGHT CONTROL APPARATUS AND METHOD THEREOF

RELATED APPLICATIONS

The present application is based on, and claims priority from, Taiwan Application Ser. No. 93123966, filed on Aug. 10, 2004, the disclosure of which is hereby incorporated by reference herein in its entirety.

FIELD OF THE INVENTION

The present invention relates to a light control method, specifically relates to a flashing light control method and apparatus thereof.

BACKGROUND OF THE INVENTION

In electrical products, it is necessary to use different flashing lights to represent different operation situations. In FIG. 1, a low pulse signal 100 controls a switching device 104 that makes a light emitting diode 102 flash.

Typically, there are two methods of generating the low pulse signal 100. One is to use a program to control a counter in a CPU to output the pulse signals from the general purpose input/output pins. The pulse signals make the switching devices switch the light emitting diodes on/off. However, the CPU has to keep working in this method, which increase the power consumption of the electrical products. Additionally, the working efficiency of the CPU is reduced because the partial calculation period is used to generate the pulse signals.

Another method is to use an oscillation circuit to generate pulse signals with a fixed period to make the switching device switch the light emitting diodes on/off. However, an additional oscillation circuit is required in this method, which increase the cost and the volume of the electrical products. Moreover, the oscillation circuit can only generate a pulse signal with a fixed period. Therefore, the flashing period is also fixed, which limits the application range thereof.

A pulse signal generator inside a CPU is typically used to resolve the problem of fixed period resulting from use of the oscillation circuit. This pulse signal generator is used to provide a pulse signal whose period is modulated by the CPU. However, although this method can resolve the fixed period problem, a pulse signal generator can only provide a pulse signal. In other words, the number of flashing lights is related to the number of pulse signal generators inside a CPU. If the number of pulse signal generators built in a CPU is not enough, an additional pulse signal generator must be attached to the CPU, which increase the manufacturing cost and the volume of a electrical product.

SUMMARY OF THE INVENTION

Therefore, the main purpose of the present invention is to provide a flashing light control method and apparatus thereof to make many lights flash but not increase the power consumption and volume of a electrical product.

Another purpose of the present invention is to provide a flashing light control method and apparatus thereof by using a pulse signal generator to make many lights flash.

A further purpose of the present invention is to provide a flashing light control method and apparatus thereof to control the flashing light period without reducing CPU efficiency.

Accordingly, the states of the general purpose Input/Output pins of a CPU can determine whether or not a light is triggered by a pulse signal generated by a pulse signal generator. The method not only can use a pulse signal generator built in a CPU but also can use a pulse signal generator independent from a CPU.

BRIEF DESCRIPTION OF THE DRAWINGS

The foregoing aspects and many of the attendant advantages of this invention will become more readily appreciated and better understood by referencing the following detailed description, when taken in conjunction with the accompanying drawings, wherein:

FIG. 5 is a control conditions table for making lights flash; and

FIG. 6 is a control conditions table for keeping lights on or off.

DETAILED DESCRIPTION OF THE PREFERRED EMBODIMENT

Figure 1:
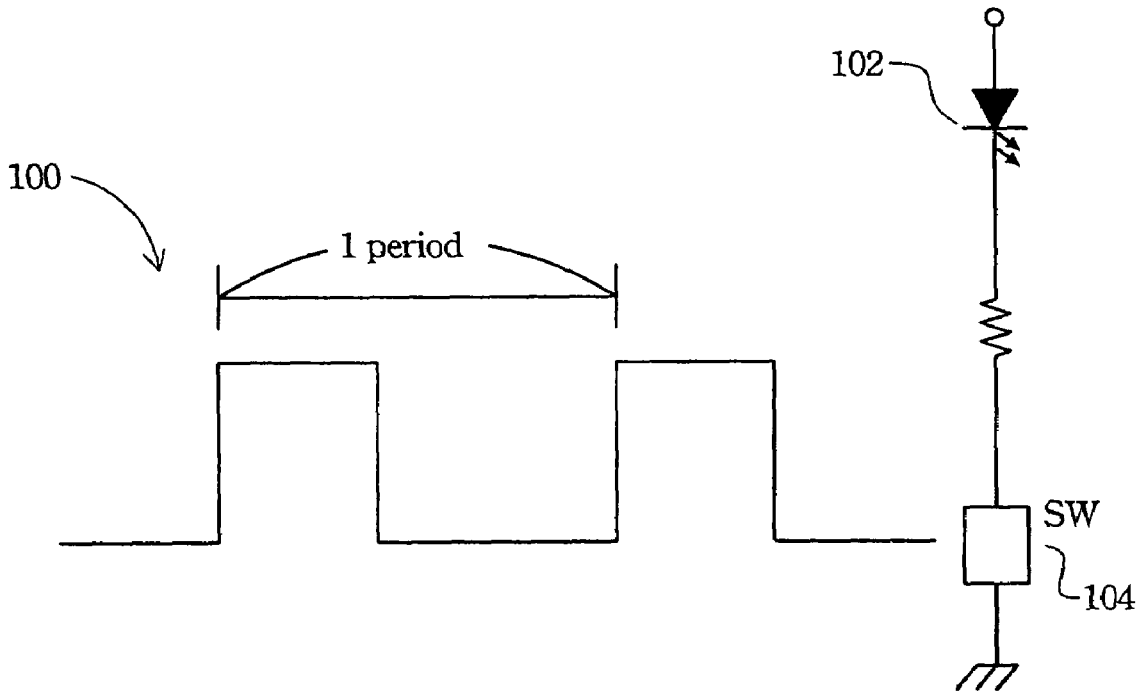
FIG. 1 is a typical pulse signal for flashing lights.
Figure 2:
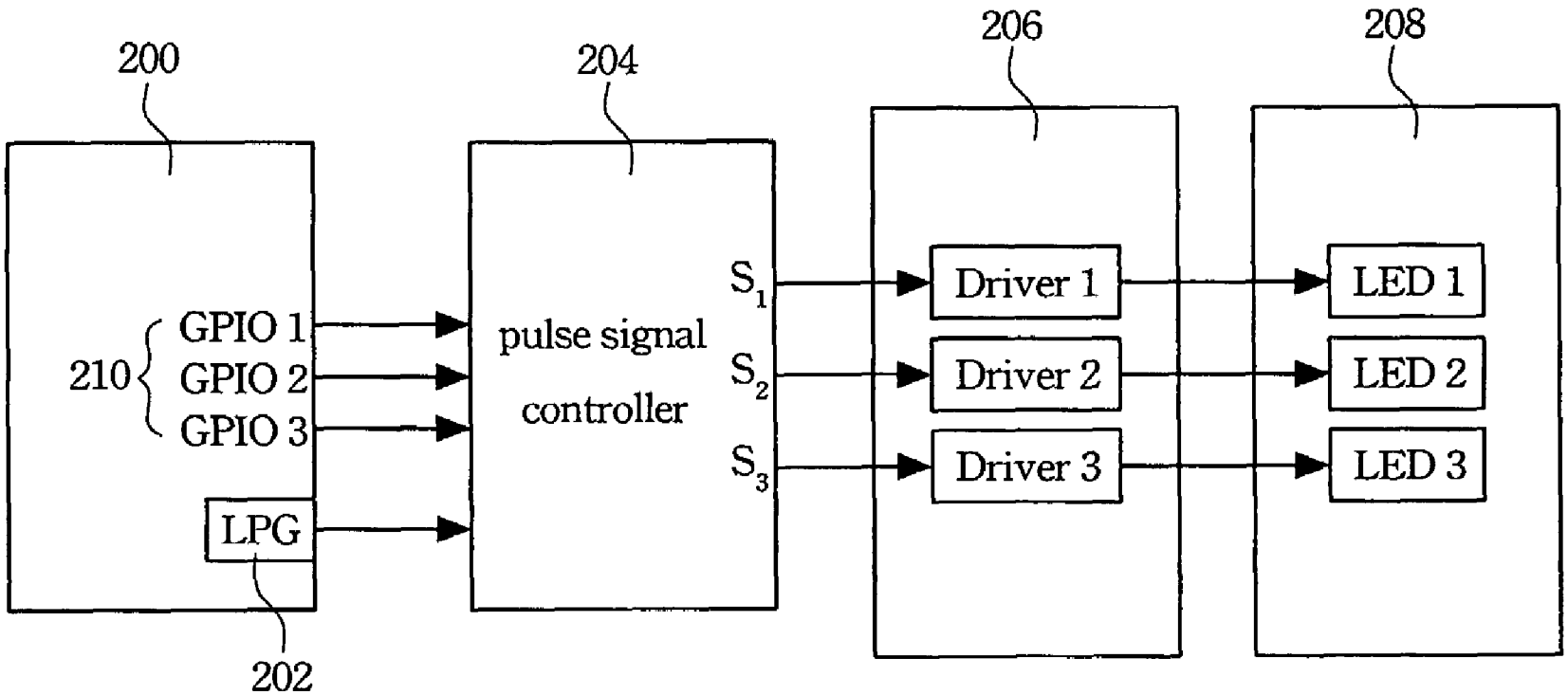
FIG. 2 is a block diagram of a control circuit according to the first embodiment.

FIG. 2 is a block diagram of a control circuit according to the first embodiment. According to the first embodiment, a CPU 200 with a low pulse generator (LPG) 202 makes lights flash by controling the states of the general purpose Input/Output (GPIO) pins 210 and thereby selecting which light flahses. The pulse signal generated by the low pulse generator 202 makes the selected light flash. A pulse signal controller 204 triggers a specific driving circuit in the driving circuitdriving circuit module 206 according to the states of the general purpose Input/Output (GPIO) pins 210 of the CPU 200. Then, the pulse signal received by the pulse signal controller 204 can make a specific light in the light module 208 flash through the triggered driving circuit. The light module is composed of light emitting diodes respectively connected to corresponding driving circuits.

Figure 3:
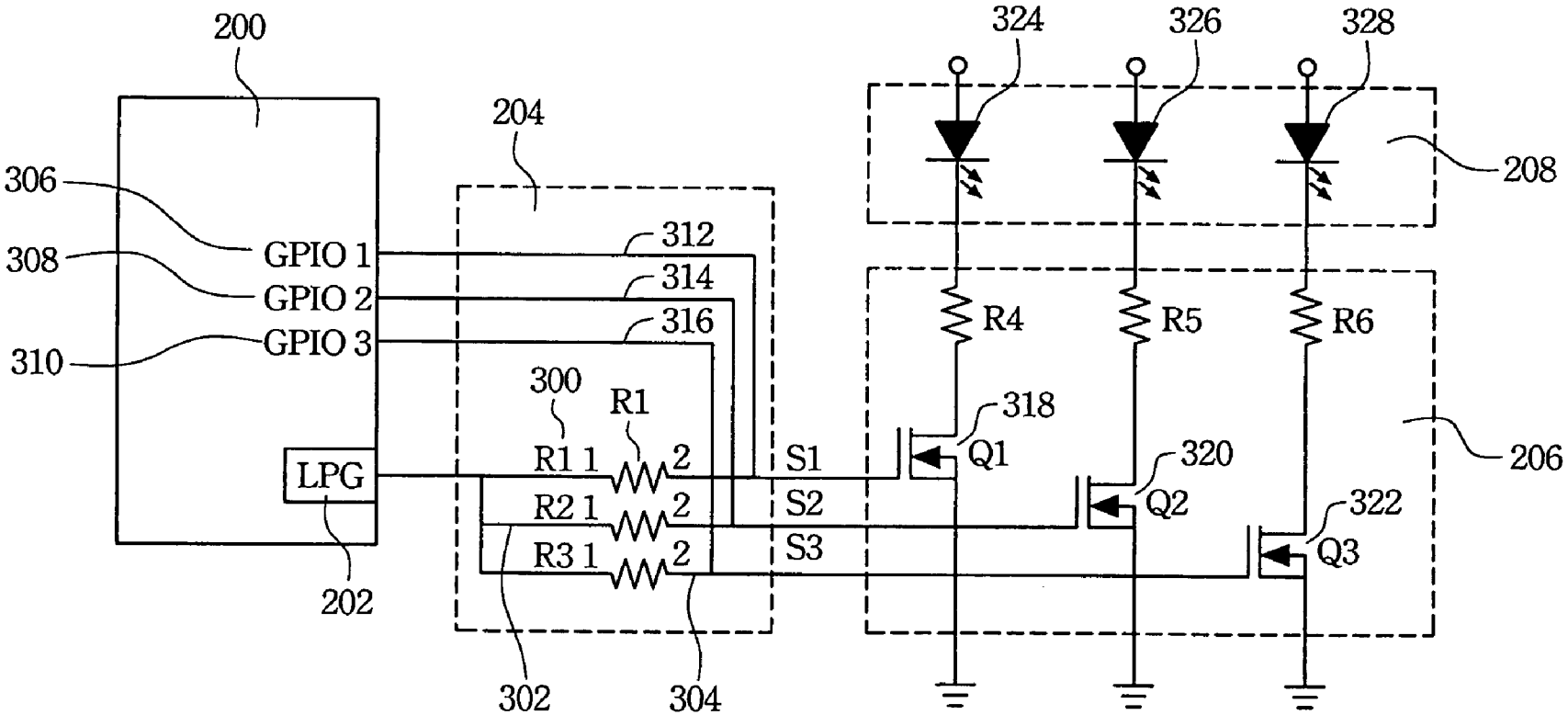
FIG. 3 is a control circuit diagram according to the block diagram illustrated in FIG. 2.

FIG. 3 is a control circuit diagram according to the block diagram illustrated in the FIG. 2. Reference is made to FIG. 2 and FIG. 3. A low pulse generator (LPG) 202 is built in a CPU 200. According to the embodiment, the conductive line 300, 302 and 304 connected with the low pulse generator 202 and the conductive lines 312, 314 and 316 connected with the CPU 200 are respectively connected together to form three intersections that serve as the three output points $S_1$, $S_2$ and $S_3$ of the pulse signal controller 204.

When the state of a general purpose Input/Output pin 210 is set in an Input mode, this pin has a "high" input impedance. When the state of a general purpose Input/Output pin 210 is set in an output mode, this pin is grounded. For example, when the general purpose Input/Output pin 306 is set in an Input mode, this pin has a "high" input impedance. Therefore, the output signal of the output point $S_1$ of the pulse signal controller 204 is the pulse signal transmitted by the conductive line 300. Conversely, when the general purpose Input/Output pin 306 is set in an output mode, this pin is grounded. The output point $S_1$ of the pulse signal controller 204 is also grounded. Therefore, the pulse signal transmitted by the conductive line 300 is reduced to a "zero" level state through the resistance R1. In other words, the output signals of the three output points $S_1$, $S_2$ and $S_3$ can be determined by controlling the states of the corresponding general purpose Input/Output pins.

There are three switching devices 318, 320 and 322 in the driving circuit module 206. The three switching devices 318, 320 and 322 are transistors. These switching devices 318, 320 and 322 are respectively controlled by the three output points $S_1$, $S_2$ and $S_3$. For example, when the output point $S_1$ is grounded because the corresponding GPIO pin 306 is set in an output mode, the switching device 318 is in an "off" state because the pulse signal transmitted by the conductive line 300 is reduced to a "zero" level state through the resistance R1. Conversely, when the corresponding GPIO pin 306 is set in an "input" mode, this pin has a "high" input impedance. Through the conductive line 312, this "high" input impedance makes the output point $S_1$ output the pulse signal transmitted by the conductive line 300 to switch the switching device 318. At this time, the corresponding light emitting diode 324 in the light module 208 flashes according to the switching of the switching device 318.

When both the GPIO pins 308 and 310 are set in the input mode and the GPIO pin 306 is set in the output mode, the output point $S_1$ is grounded to turn of the switching device 318, and the output points $S_2$ and $S_3$ respectively output the pulse signal transmitted from the conductive lines 302 and 302 to switch the switching devices 320 and 322. At this time, the light emitting diode 324 is turned off because the switching device is in an "off" state. The light emitting diodes 326 and 328 flash according to the switching of the switching devices 320 and 322.

On the other hand, the light emitting diodes can be kept on in the present invention. In such situation, the LPG 202 is turned off to stop providing the pulse signal. Therefore, the three output points $S_1$, $S_2$ and $S_3$ of the pulse signal controller 204 are only controlled by the GPIO pins. For example, when the GPIO pin 306 outputs a "high" level such that the output point $S_1$ is also in a "high" level, the switching device 318 is kept in an "on" state, thereby making the LED 324 continuously on.

Figure 4:
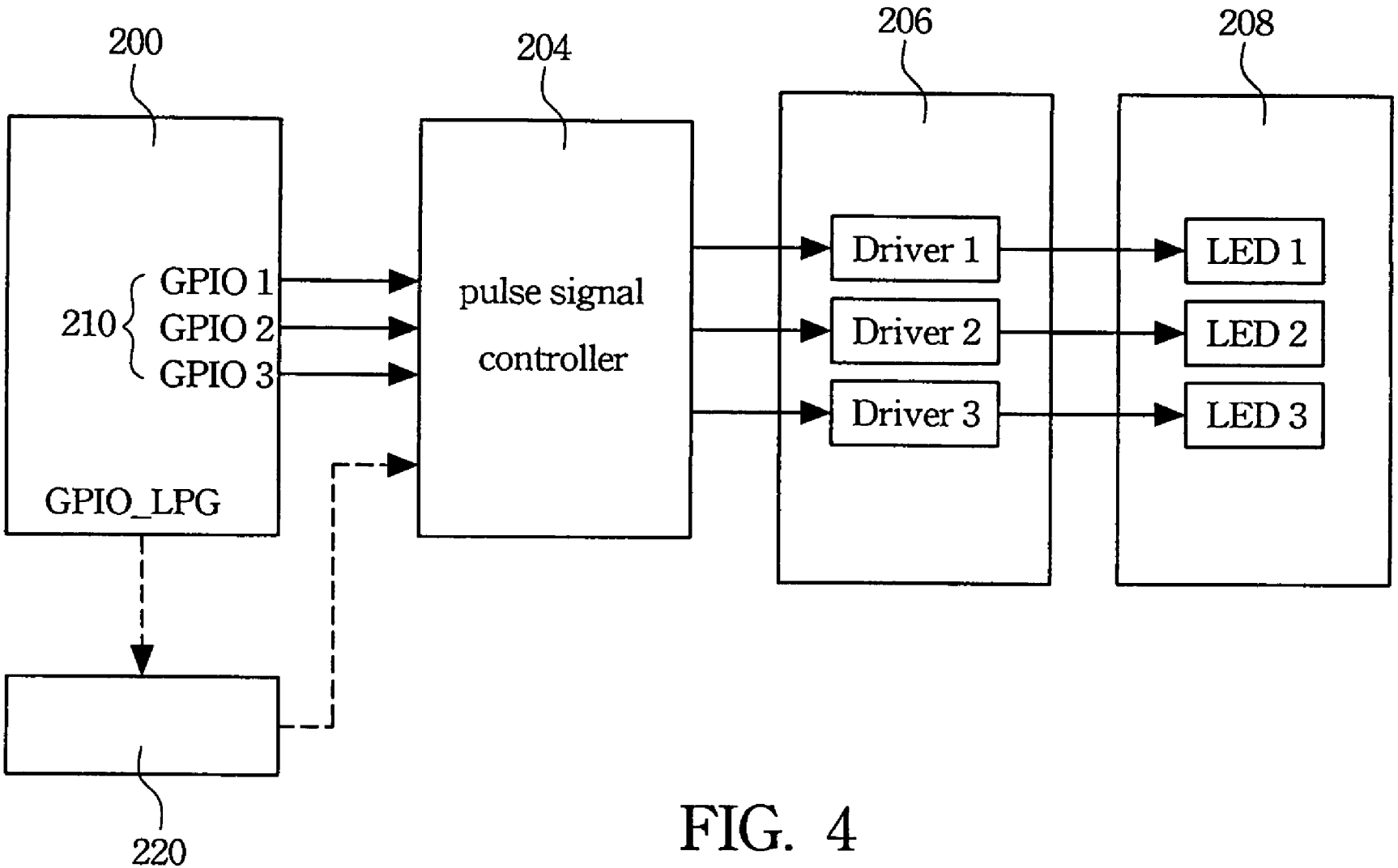
FIG. 4 is a block diagram of a control circuit according to the second embodiment.

FIG. 4 is a block diagram of a control circuit according to the second embodiment. The main difference between the first and second embodiment is that an independent LPG 220 controlled by a GPIO pin of the CPU 200 is used in the second embodiment to generate the pulse signal. However, the operation method of the first and second embodiment is the same.

FIG. 5 is a control conditions table for making light emitting diodes (LEDs) flash. Reference is made to FIG. 3 and FIG. 5 together. For example, the situation described in number 3 is that the LED 328 flashes and the LEDs 324 and 326 are off. In such situation, the GPIO pin 310 is set in the input mode and the GPIO pins 306 and 308 are set in the output mode. According to the setting of the pins, the output point $S_1$ and $S_2$ are grounded. Therefore, the switching devices 318 and 320 are turned off. The LED 324 and 326 are turned off. The output point $S_3$ outputs the pulse signal transmitted by the conductive line 304 to switch the switching device 322. The LED 328 flahs according to the switch of the switching device 322. On the other hand, the situation described in number 8 is that the LEDs 324, 326 and 328 are all turned off. In such situation, all of the GPIO pins 306, 308 and 310 of the CPU 200 are set in the output mode. It is noted that the control condictions described in FIG. 5 also can be used in the circuit structure illustrated in FIG. 4.

The present invention also can maintain the light emitting diodes in on/off states. FIG. 6 illustrates a control conditions table. For example, the situation described in number 13 is that the LEDs 326 and 328 are continually on and the LEDs 324 is off. In this situation, the LPG 202 is turned off to stop the flashing function. The GPIO pins 308 and 310 are set in the output mode with a high level and the GPIO pin 306 is set in the output mode with a low level. According to the setting of the pins, the output point $S_1$ is grounded to turn off the switching device 318. Therefore, the LED 324 is turned off. The output points $S_2$ and $S_3$ output the high level signal to turn on the switching devices 320 and 322. Therefore, the LEDs 326 and 328 are continually turned on. On the other hand, the situation described in number 16 is that the LEDs 324, 326 and 328 are all turned off. In this situation, all GPIO pins 306, 308 and 310 of the CPU 200 are set in the output mode with a low level. It is noted that the control conditions described in the FIG. 6 also can be used in the circuit structure illustrated in the FIG. 4.

Accordingly, the states of the general purpose Input/Output pins of a CPU are used to make a pulse signal controller generate an output signal. This output signal selects a specific driving circuit. A pulse signal generated by a pulse signal generator triggers this selected driving circuit, which then makes the corresponding light flash. The pulse signal generator not only can be a pulse signal generator built in a CPU but also can be a pulse signal generator located outside a CPU and controlled by a GPIO pin of a CPU.

As is understood by a person skilled in the art, the foregoing descriptions of the preferred embodiment of the present invention are an illustration of the present invention rather than a limitation thereof. Various modifications and similar arrangements are included within the spirit and scope of the appended claims. The scope of the claims should be accorded to the broadest interpretation so as to encompass all such modifications and similar structures. While a preferred embodiment of the invention has been illustrated and described, it will be appreciated that various changes can be made therein without departing from the spirit and scope of the invention.

What is claimed is:

1. A flashing light control apparatus, comprising:

a central processing unit with a plurality of general purpose input/output pins, wherein each pin has a specific impedance state;

a pulse signal generator connecting to said central processing unit for generating a first pulse signal;

a pulse signal controller connecting to said pulse signal generator and said input/output pins, wherein said pulse signal controller has a plurality of output points, said output points are controlled by corresponding input/output pins, said pulse signal controller receives said first pulse signal to generate a plurality of second pulse signals and said second pulse signals are outputted from corresponding output points based on the impedance states of said input/output pins;

a driving circuit module with a plurality of driving circuits respectively connected to said output points of said pulse signal controller; and a light module with a plurality of lights respectively connected to said driving circuits, wherein said pulse second signals trigger corresponding driving circuits to turn on corresponding lights.

2. The apparatus of claim 1, wherein said driving circuits comprises transistors.

3. The apparatus of claim 2, wherein said transistors comprise MOS transistors.

4. The apparatus of claim 1, wherein said pulse signal generator is built in said central processing unit.

* * * * *